US011460192B2

(12) United States Patent
Koetz

(10) Patent No.: US 11,460,192 B2
(45) Date of Patent: Oct. 4, 2022

(54) SYSTEM FOR THE PREPARATION OF AT LEAST ONE FOOD PRODUCT AND METHOD FOR OPERATING THE RELEVANT SYSTEM

(71) Applicant: Vorwerk & Co. Interholding GmbH, Wuppertal (DE)

(72) Inventor: Hendrik Koetz, Wetter (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 16 days.

(21) Appl. No.: 16/084,226

(22) PCT Filed: Apr. 20, 2016

(86) PCT No.: PCT/EP2016/058813
§ 371 (c)(1),
(2) Date: Sep. 12, 2018

(87) PCT Pub. No.: WO2017/182074
PCT Pub. Date: Oct. 26, 2017

(65) Prior Publication Data

US 2019/0086096 A1 Mar. 21, 2019

(51) Int. Cl.

| | |
|---|---|
| ***F24C 7/08*** | (2006.01) |
| ***H05B 6/64*** | (2006.01) |
| ***H05B 6/68*** | (2006.01) |

(52) U.S. Cl.
CPC ..... *F24C 7/08* (2013.01); *H05B 6/6435* (2013.01); *H05B 6/6447* (2013.01); *H05B 6/687* (2013.01)

(58) Field of Classification Search
CPC ..... F24C 7/08; H05B 6/687; H05B 6/6447; H05B 6/6435
USPC ..... 219/681, 682, 690, 704, 730, 756
See application file for complete search history.

(56) References Cited

U.S. PATENT DOCUMENTS

| | | | | |
|---|---|---|---|---|
| 5,693,247 | A | 12/1997 | Bu et al. | |
| 5,736,717 | A | 4/1998 | Lee et al. | |
| 2009/0236335 | A1 | 9/2009 | Ben-Shmuel et al. | |
| 2015/0285513 | A1* | 10/2015 | Matarazzi | F24C 7/08 99/342 |
| 2015/0289324 | A1* | 10/2015 | Rober | H05B 6/68 219/711 |
| 2016/0048720 | A1* | 2/2016 | Palmer | G06F 16/50 382/110 |

(Continued)

FOREIGN PATENT DOCUMENTS

| | | |
|---|---|---|
| CN | 1120148 | 4/1996 |
| CN | 1152092 | 6/1997 |

(Continued)

OTHER PUBLICATIONS

International Search Report and the Written Opinion dated Nov. 24, 2016 From the International Searching Authority Re. Application No. PCT/EP2016/058813 and Its Translation of Search Report Into English. (12 Pages).

(Continued)

*Primary Examiner* — Thien S Tran

(57) ABSTRACT

The invention relates to a system for the preparation of at least one food product (2) as well as a method for the same, wherein the system (1, 50) comprises a cooking chamber (3), in which the food product (2) can be prepared.

26 Claims, 5 Drawing Sheets

(56) References Cited

U.S. PATENT DOCUMENTS

| | | | | |
|---|---|---|---|---|
| 2016/0192446 | A1* | 6/2016 | Seddik | H05B 6/6482 219/705 |
| 2017/0115008 | A1* | 4/2017 | Erbe | F24C 7/081 |
| 2017/0188416 | A1* | 6/2017 | Beifuss | H05B 6/6414 |
| 2017/0208652 | A1* | 7/2017 | Luckhardt | H04N 5/2256 |
| 2018/0324908 | A1* | 11/2018 | Denker | G06T 7/0002 |

FOREIGN PATENT DOCUMENTS

| | | | | |
|---|---|---|---|---|
| CN | 101398197 | | 4/2009 | |
| CN | 101504158 | A * | 8/2009 | |
| DE | 19718399 | | 11/1998 | |
| DE | 102011087274 | | 5/2013 | |
| DE | 102013225404 | | 6/2015 | |
| WO | WO 2010/102261 | | 9/2010 | |
| WO | WO2015-185608 | * | 10/2015 | F24C 7/018 |
| WO | WO-2015185632 | A1 * | 12/2015 | H05B 6/6414 |
| WO | WO-2016034295 | A1 * | 3/2016 | H04N 5/2256 |
| WO | WO 2017/182074 | | 10/2017 | |

OTHER PUBLICATIONS

Notification of Office Action and Search Report dated Aug. 5, 2019 From the China National Intellectual Property Administration Re. Application No. 201680082066.7 and Its Translation Into English. (17 Pages).

Notification of Office Action dated Apr. 22, 2020 From the China National Intellectual Property Administration Re. Application No. 201680082066.7 and Its Translation Into English. (10 Pages).

Examination Report dated Oct. 13, 2020 From the Instituto Mexicano de la Propiedad Industrial, Direction Divisional de Patentes Re. Application No. MX/a/2018/012864 and Its English Summary. (5 Pages).

Mitteilung Gemaess Artikel 94(3) EPUe [Communication Pursuant to Article 94(3) EPC] dated Jan. 14, 2021 From the European Patent Office Re. Application No. 16717921.7 and Its Summary in English. (6 Pages).

State Intellectual Property Office of the People's Republic of China Re. Application No. 201680082066.7 and Its Translation of Office Action Into English. (21 Pages).

Chen Zhonghai "System Simulation Technology and Application (16)", Press of University of Science and Technology of China: 4P., Aug. 31, 2016. (Chinese only).

Shanghai Economy and Information Technology Commission, et al., "The Development of Key Manufacturing Industries in the World", Shanghai Scientific and Technological Literature Press: 3P., Oct. 31, 2015. (Chinese only).

Examination Report dated Nov. 18, 2021 From the Australian Government, IP Australia Re. Application No. 2016403900. (4 Pages).

* cited by examiner

SYSTEM FOR THE PREPARATION OF AT LEAST ONE FOOD PRODUCT AND METHOD FOR OPERATING THE RELEVANT SYSTEM

RELATED APPLICATIONS

This application is a National Phase of PCT Patent Application No. PCT/EP2016/058813 having International filing date of Apr. 20, 2016. The contents of the above application are all incorporated by reference as if fully set forth herein in its entirety.

FIELD AND BACKGROUND OF THE INVENTION

The invention relates to a system for the preparation of at least one food product as well as to a method for the same.

At present, systems are known in which the user has to transmit a plurality of information about the cooking process as well as about the food product to be cooked to said system. This is time-consuming for the user. Moreover, there is the problem that the food product is often not optimally cooked inside the cooking chamber despite correct input of the above-mentioned information.

SUMMARY OF THE INVENTION

It is an object of the present invention to at least partially overcome the disadvantages described above. In particular, it is an object of the present invention to provide an improved system for the preparation of at least one food product as well as a method therefor, so that the food product will be cooked in a manner as flawless as possible inside the cooking chamber.

The aforementioned object is achieved by means of a system having all of the features of claim 1, as well as by means of a method having all of the features of claim 22.

Further features and details of the invention result from the respective sub-claims, the description and the drawings. Features and details that have been described in conjunction with the method according to the invention naturally also apply in conjunction with the system according to the invention and vice versa, so that reference is or can always mutually be made to the individual aspects of the invention in regard to the disclosure.

The object is, in particular, achieved by a system for the preparation of at least one food product, having a cooking chamber in which the food product can be prepared, wherein the system comprises an object detection for the automatic determination of input parameters of the food product, a control unit, which determines cooking data based upon the input parameters, and an energy unit in order to provide a supply of energy into the cooking chamber specific to the food product dependent upon the cooking data.

It is particularly provided here that the object detection automatically detects defined input parameters of the food product in order that the system can generate corresponding cooking data, so that the energy unit can supply energy into the cooking chamber in a manner exactly adapted to the food products located in the cooking chamber, so that the food products can be brought or cooked into an as optimal and edible state as possible. Through the inventive idea, a preparation provision for cooking the food product located in the cooking chamber is automatically used, so that no time-consuming or error-prone input of cooking data into the system by the user is required. By means of the system according to the invention, the cooking data of the respective food product can precisely be determined and, in particular, the preparation provision can be adjusted for the cooking in such a way that e.g. large and heavy food products will be cooked longer and/or at a higher temperature. Accordingly, small and light food products, in particular of the same category or type, are prepared or cooked shorter and/or at a lower temperature by the system according to the invention. The invention includes that multiple food products of the same type and/or of different type are prepared simultaneously, wherein the supply of energy on to the respective food product takes place differently. The system can be configured in such a way here that the cooking duration is equal for all food products located in the cooking chamber. The system can, of course, also take into consideration that the cooking duration is different during the preparation dependent upon the respective food product. According to the invention, the system can be configured in such a way the user is able to make changes individually in terms of the cooking data, in the scope of the preparation provision, of course. This means that the system leaves room to the user in regard to certain cooking data that can be adjusted individually by them. This results in further cooking data, such as the cooking temperature, which is then fixedly predetermined by the system.

Preferably, the input parameter can be at least one of the following parameters of the food product:

size,
weight,
type,
quantity,
temperature,
position in the cooking chamber.

The above input parameters are not to be considered to be a comprehensive list, but further parameters can of course be considered as input parameters. The size and the weight as input parameters are advantageous in one embodiment of the invention in order to determine a corresponding cooking duration and/or cooking temperature for the respective food product for the preparation provision. As a matter of fact, the type of food product and/or the quantity of the food products can be important to determine corresponding cooking data. The input parameter temperature can likewise be considered by the system according to the invention, wherein the temperature is the temperature of the food product. In order that the food product in the cooking chamber can be applied upon with the corresponding energy for cooking in a target manner, the position in the cooking chamber can be helpful for the system as an information.

According to the invention, it can be provided that the system is a cooking device which comprises the cooking chamber and/or the energy unit and/or the object detection, in particular that the cooking device is an oven. The cooking chamber can be formed to be closed or open inside the system, in particular the cooking device. The cooking device can, in addition, be part of an oven-cooktop-combination. Alternatively, the cooking device can be a distinct cooktop.

According to the invention, the preparation of the respective food product concerns a cooking by means of the system, which can include, for example, a wet cooking technique or a dry cooking technique. In the wet cooking technique, utilization of water is important. The following wet cooking techniques are conceivable here: cooking, steam cooking, stewing, poaching, pressure cooking, low-temperature cooking or vacuum cooking. Dry cooking techniques are also comprised by this invention, such as roasting, sautéing, grilling, frying, braising. In another embodiment of the invention, the energy unit can emit a high-frequency radiation into the cooking chamber, which can be in particular between 2 GHz and 3 GHz, in particular preferably 2.4 GHz. An efficient preparation of the food product can be achieved hereby.

Advantageously, in the scope of the invention, the object detection may comprise at least one camera, by which at least one input parameter can be determined, in particular, the camera can be integrated in the cooking device. For example, the camera can be configured in such a way that it collects information in order to determine the size and/or the weight and/or the type and/or the quantity and/or the temperature of the food product and/or the position in the cooking chamber of the food product. It is conceivable that the camera captures one or multiple images of the food product. Advantageously, the object detection is effected by means of optical detection methods, for example with one or multiple cameras. The invention likewise includes that the object detection takes place via acoustic or other physical detection methods.

Advantageously, the object detection comprises one or multiple image sensors, so that one or multiple input parameters of the food product can be detected. Furthermore, the object detection may include at least one 2D camera or 3D camera, so that the size and/or the volume can be detected as input parameter, for example.

Furthermore, it is conceivable that the object detection comprises the control unit and/or a device for measuring at least one input parameter, in particular the weight. Preferably, the object detection is configured in such a way that the yet missing input parameter such as "weight" is calculated and/or determined from defined input parameters.

Alternatively, a separate device for measuring the weight can be provided, wherein the device is configured as a scale. In this embodiment, the object detection determines at least a part of the input parameters of the food product, wherein the device for measuring the weight is provided separately in the system. According to the invention, all input parameters are transmitted to the control unit, which determines the cooking data based upon the input parameters.

Another advantage can be achieved in the scope of the invention in that a database is provided, from which functional data for determining the cooking data can be read out by the control unit or from which the cooking data can be read-out by the control unit, in particular in that the cooking device comprises the database. The database can, for example, contain functional data which only make a determination of the cooking data possible. It is conceivable, for example, that the object detection determines at least the input parameter "size" as well as "type". The missing input parameter "weight" can, for example, be determined from the functional data, in that the density with respect to the type of food product is stored in the functional data and, as a consequence, the weight can be calculated thereupon: Density*volume=mass (weight). The database can be integrated in the control unit, wherein the functional data can be changed in a further possible embodiment of the invention, for example successively by the user during use of the system.

It is also advantageous that the cooking device comprises walls which define the cooking chamber, in particular that the walls include a bottom, side walls and a ceiling. Advantageously, the cooking device comprises a closing element, in particular a door, which is in a closed position in the cooking process, whereby the cooking chamber is closed-off from the surroundings.

Furthermore, it is conceivable in the scope of the invention that the energy unit is arranged in at least one wall, wherein the energy unit comprises a plurality of energy elements, which are arranged in or on the at least one wall in such a way that a planar energy unit results. A particular efficient energy input is effected in the case that the energy unit is arranged in the ceiling or in the bottom of the cooking device. Likewise, it can be provided that the energy unit is integrated in all of the walls, whereby a highly-efficient cooking can be realized.

Furthermore, the system according to the invention includes that the planar energy unit is adapted to the dimensions of the at least one wall, in which or on which the energy unit is arranged, wherein the planar energy unit corresponds to at least 50% of the dimensions of the at least one wall, preferably the planar energy unit corresponds to at least 80% of the dimensions of the at least one wall. Each wall comprises a surface facing the cooking chamber. The planar energy unit advantageously has the dimension of this surface, whereby an efficient energy input into the cooking chamber can be realized.

Advantageously, it turned out that the energy element is formed as an antenna, by means of which energy can be emitted into the cooking chamber as high-frequency radiation. It is conceivable here that the antennas are formed in such a way that they can be controlled individually, so that a plurality of cooking chamber zones are created in the cooking chamber. In accordance with the determined cooking data, the object detection in particular the control unit, can make sure that the energy unit is operated in a tailor-made manner with respect to the food product located in the cooking chamber. Energy is supplied only to the regions inside the cooking chamber in which the food product is located. The cooking data can naturally be different from cooking zone to cooking zone.

In addition, it can advantageously be provided that the cooking device comprises a display by means of which at least one input parameter and/or cooking data can be displayed. The display can likewise serve as an input device in order to enable the user to select and/or input at least one input parameter and/or one or multiple cooking data.

It can further be possible that a cloud is provided, which comprises the database and/or the control unit. The cloud can be a network, in particular a computer network, wherein multiple systems according to the invention can be in data communication with the cloud. The object detection and/or the control unit of the system can exchange data, in particular input parameters and/or cooking data with one another, for example via the cloud, whereby an efficiency increase can be achieved for the preparation of the at least one food product or an improved automatic determination of input parameters can be realized by the object detection. The system with the cloud and/or the overall system, which is formed from multiple systems according to the invention, in particular with the cloud, can be self-learning. The invention can include a knowledge-based system, in particular an expert system, for example.

In addition, it is conceivable that the object detection takes place outside the cooking chamber. Advantageously, at least one wall of the cooking device must make it possible to automatically determine input parameters of the food product. Preferably, a wall comprises a type of window, so that the external object detection is directed through this window into the cooking chamber to determine input parameters of the food product.

Likewise conceivable in the scope of the invention is that the object detection carries out the determination of input parameters of the food product outside the cooking device. After that, the user puts the food products into the cooking chamber, which, in the next step, can be cooked correspondingly by the energy unit.

In addition, it can be conceivable according to the invention that the object detection is a mobile object detection device, by means of which at least partially input parameters can be determined outside the cooking chamber, wherein the object detection device comprises communication interfaces, so that a data communication between the cloud and/or the cooking device and/or the control unit is made possible. The mobile object detection device may comprise all of the features that have been described above in conjunction with the object detection arranged on the cooking device. The mobile object detection device can be, for example, a mobile telephone, which, on the one hand, comprises the function for determining the input parameters. On the other hand, it can be provided with the control unit, which determines cooking data for this purpose, by means of which the system according to the invention can operate the energy unit correspondingly in order to be able to cook the food products correspondingly.

In addition, it can be essential to the invention that the object detection comprises a light source for the illumination of the cooking chamber. It turned out that an improved object detection is achieved when the cooking chamber is illuminated correspondingly, so that input parameters of the food product can be determined in a satisfactory manner via the object detection.

It is further possible to provide a thermal insulation between the object detection and the cooking chamber. The thermal insulation is advantageous only in the case that the object detection is arranged inside or on the cooking chamber, whereby the objected detection can effectively be protected against radiation, heat, dirt, dust, etc.

The invention also relates to a method having the features of claim 22. Thus, the method provides the same advantages as have been described in detail with reference to the system according to the invention.

Advantageously, the method comprises a database with functional data, which are at least partially in combination with the input parameters. The input parameters can be at least one of the following parameters of the food product: Size, weight, type, quantity, temperature, position in the cooking chamber. The cooking data determine a preparation provision for cooking the food product, wherein the cooking data can be at least one of the following parameters: Cooking duration and cooking temperature. Advantageously, a determination of the input parameters and/or of the cooking data can be effected based upon the functional data.

Advantageously, the object detection determines at least the input parameters type and/or size of the food product, wherein the input parameter "weight" is calculated in consideration of functional data.

Alternatively, it is conceivable that the object detection determines and/or measures at least the input parameters type and/or size and/or weight of the food product. For example, the method according to the invention includes that the input parameters type and size of the food product are detected and determined via the object detection, wherein the weight of the food product is measured via a separate measuring device. The measured input parameter is subsequently used for the determination of the cooking data.

In addition, the method according to the invention includes that the energy unit comprises a plurality of energy elements, which in particular are arranged side by side, so that energy can be supplied to the cooking chamber in a uniform manner, wherein energy can be supplied to the cooking chamber in such a way dependent upon the input parameters and/or cooking data that multiple cooking chamber zones are created, which can be operated with different cooking data. Food products can thereby be prepared particularly efficiently and effectively inside the cooking chamber.

Advantageously, the method according to the invention can be configured in such a way that the object detection is in data communication with an external unit, in order to capture the input parameters and/or cooking data and/or pictures of the food product during the cooking process and send them to the external unit, wherein the external unit is a mobile computer and/or a mobile phone and/or a tablet computer and/or a display device. The user can read various information from the external unit. In addition, in a further embodiment of the method according to the invention, it can be conceivable that the method according to the invention can be controlled and/or regulated via the external unit. This means, for example, that the user can change cooking data, which, according to the invention, have been automatically determined by the method.

BRIEF DESCRIPTION OF THE SEVERAL VIEWS OF THE DRAWINGS

Further advantages, features, and details of the invention result from the following description, in which multiple exemplary embodiments of the invention are described in detail with reference to the drawings. The features mentioned in the claims and description can each per se or in any combination be essential to the invention. The Figures show in:

DESCRIPTION OF SPECIFIC EMBODIMENTS OF THE INVENTION

Figure 1:
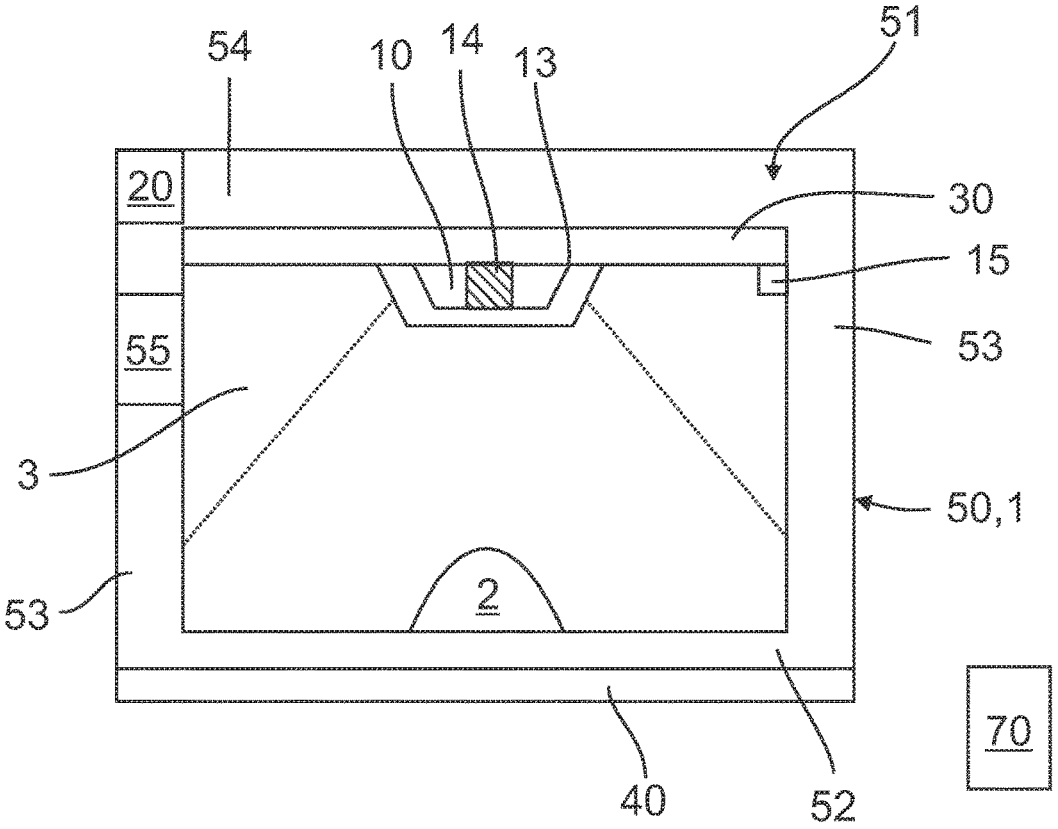
FIG. 1 a schematic representation of a system according to the invention, in particular a cooking device, FIG. 2 a schematic representation of a system according to the invention, in particular a cooking device, with a cloud, FIG. 3 a schematic illustration for determining the input parameters and cooking data, FIG. 4 a schematic representation of a system according to the invention, in particular a cooking device in a further exemplary embodiment, FIG. 5 a schematic representation for determining cooking data, FIG. 6 another schematic representation of an alternative exemplary embodiment for determining cooking data, FIG. 7 a further exemplary embodiment for determining cooking data, FIG. 8 a further exemplary embodiment for determining cooking data, FIG. 9 a possible exemplary embodiment of an energy unit, which can be used in a system according to the invention, FIG. 10 a further exemplary embodiment of a system according to the invention, in particular a cooking device, FIG. 11 an exemplary embodiment of a system according to the invention with a mobile object detection, which is in data communication with a cloud and the cooking device according to the invention FIG. 12 a further exemplary embodiment of a system according to the invention.

FIG. 1 shows a system 1, 50 for the preparation of at least one food product 2. The system 1, 50 shown in FIG. 1 comprises a cooking chamber 3, in which the food product 2 is located. The system 1, 50 comprises an object detection 10 for the automatic determination of input parameters 100 of the food product 2. The object detection 10 is located inside the cooking chamber 3 above the food product 2 in the illustrated exemplary embodiment. In addition, the system 1, 50 comprises a control unit 20, which is capable of determining cooking data 110 based upon the input parameters 100. Through an energy unit 30 present in the system 1, 50, energy can be supplied to the food product 2 dependent upon the cooking data 110.

The input parameters 100 can be the following parameters of the food product 2: size 101 of the food product 2, weight 102 of the food product 2, type 103 of the food product 2, quantity 104 of the food product, temperature of the food product 2 as well as position 106 of the food product 2 in the cooking chamber 3.

The listed parameters are not to be understood as a complementary list here.

Figure 4:
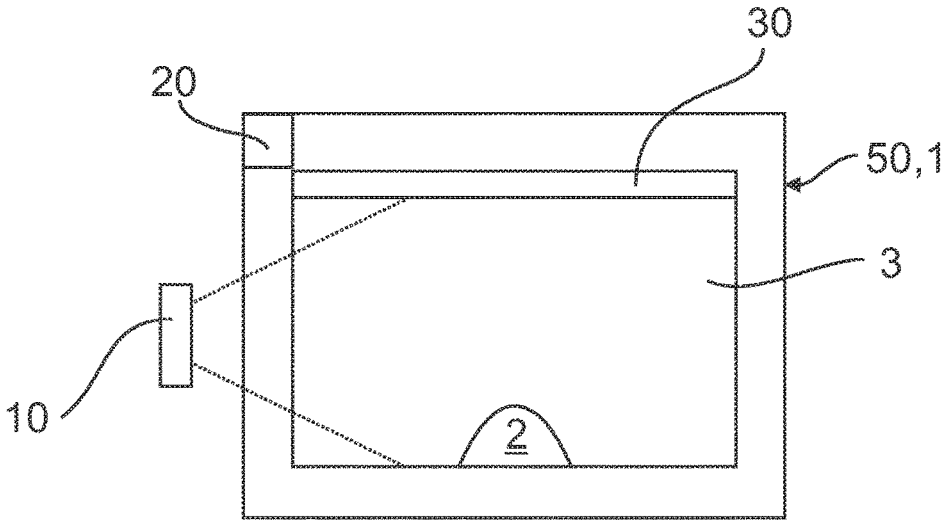

The cooking data 110 determines a preparation provision for cooking the food product 2, wherein the cooking data 110 can be at least one of the following parameters: cooking duration 111 and cooking temperature 112. In the present exemplary embodiment, the system 1, 50 is a cooking device 50 which is formed as an oven, wherein the cooking device 50 comprises walls 51 that define the cooking chamber 3. Alternatively, the inventive idea also includes that the cooking chamber 3 is configured to be open, i.e. no walls delimit the cooking chamber 3. According to FIG. 1, a bottom 52, side walls 53, a ceiling 54 as well as a door not visibly shown define the cooking chamber 3. The object detection 10 is arranged on the ceiling 54. It is likewise conceivable according to all exemplary embodiments that the object detection 10 is arranged in one of the walls 51 in a completely integrated manner. As an alternative to FIG. 1, the inventive idea also includes that the object detection 10 can likewise be arranged outside the cooking chamber 3, which is schematically indicated in FIG. 4.

The object detection 10 can comprise, for example, at least one camera 14, by means of which at least one of the aforementioned input parameters 100 can be determined. It is conceivable, for example, that the object detection 10 is configured with one or multiple 2D cameras or 3D cameras, in order to determine the input parameters 11 in an efficient manner. In one possible embodiment of the invention, the object detection 10 detects the size of the food product 2. The system of the cooking device 50 can additionally detect the type 103 of the food product 2, the quantity 104 of the food product 2 as well as further input parameters 100, which have been mentioned here already, for example, from the data of the object detection 10. The weight 102 can likewise be determined through the object detection 10, wherein, for example via a database 120 according to FIG. 7 or FIG. 8, the control unit 20 obtains corresponding functional data 130 about determined input parameters. The functional data 130 can be used to calculate the weight 102. For example, parameter 101 (volume) can be determined to be an input parameter 100. In addition, the object detection 10 can detect the input parameters 103, 104 as well as 106. In the database 120, the density of the food product 2 can be stored. Due to having learned the input parameter 103, the control unit 20 can calculate the weight 102 as an input parameter as follows: Mass=density*size (volume).

Figure 7:
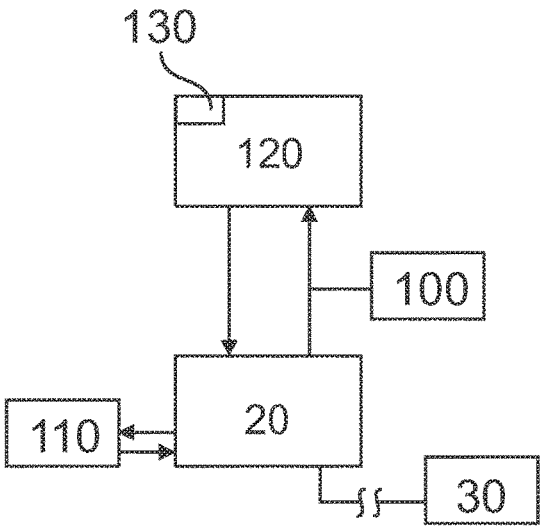

As a result, the cooking data 110 can be determined, wherein the control unit 20 provides this cooking data 110 subsequently to the energy unit 30 in accordance with FIG. 7.

Figure 8:
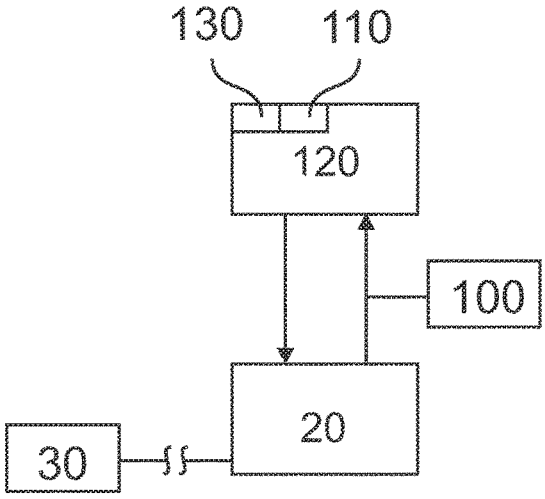

It is shown according to FIG. 8 that cooking data 110 is integrated in the database 120 in addition to the functional data 130, so that the control unit 20 obtains or can read-out at least partially or all cooking data 110 from the database 120.

FIG. 1 schematically shows another alternative for determining the input parameter "weight" 102. The system 1, 50 comprises a device 40 to measure the weight of the food product 2. Thus, the cooking device 50 is an oven with an integrated scale. For example, the device 50 may comprise integrated extension strips, which are not explicitly shown, by means of which the input parameter "weight" 102 of the food product 2 can be determined. Alternative measuring methods are naturally conceivable for the determination of the weight. In this exemplary embodiment, the object detection thus determines some of the input parameters 100, but the device 40 has the function to determine the input parameter 102.

Figure 5:
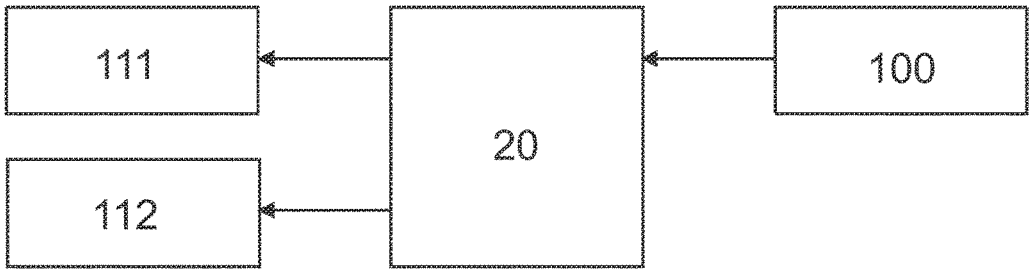
Figure 6:
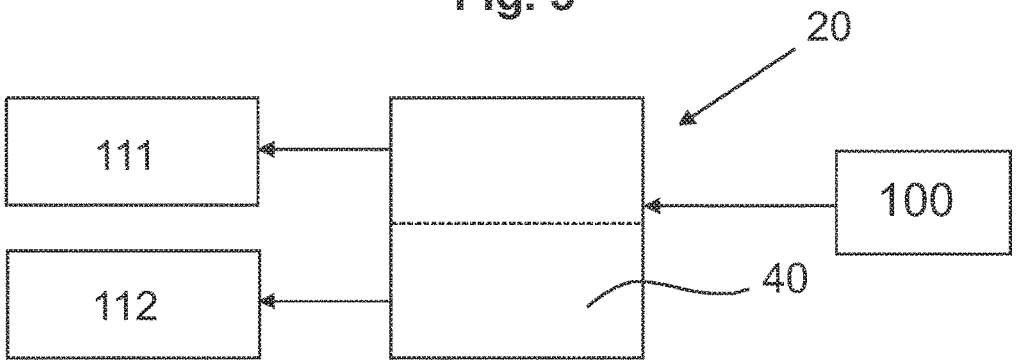

Regardless of whether the object detection 10 determines all input parameters 100 or one input parameter 102 is at least partially determined by the device 40, all input parameters 100 are handed over to the control unit 20, which determines the cooking data 111, 112 dependent upon the input parameters 100, which is schematically shown in FIG. 5 and FIG. 6. In FIG. 5, all cooking data 111, 112 can be determined via the object detection 10. In FIG. 6, it is schematically shown that the control unit 20 can determine some of the cooking data 111 from the determined input parameters 100. Another part of the cooking data 112 is, first, measured via the device 40 and subsequently provided to the control unit 20.

Figure 9:
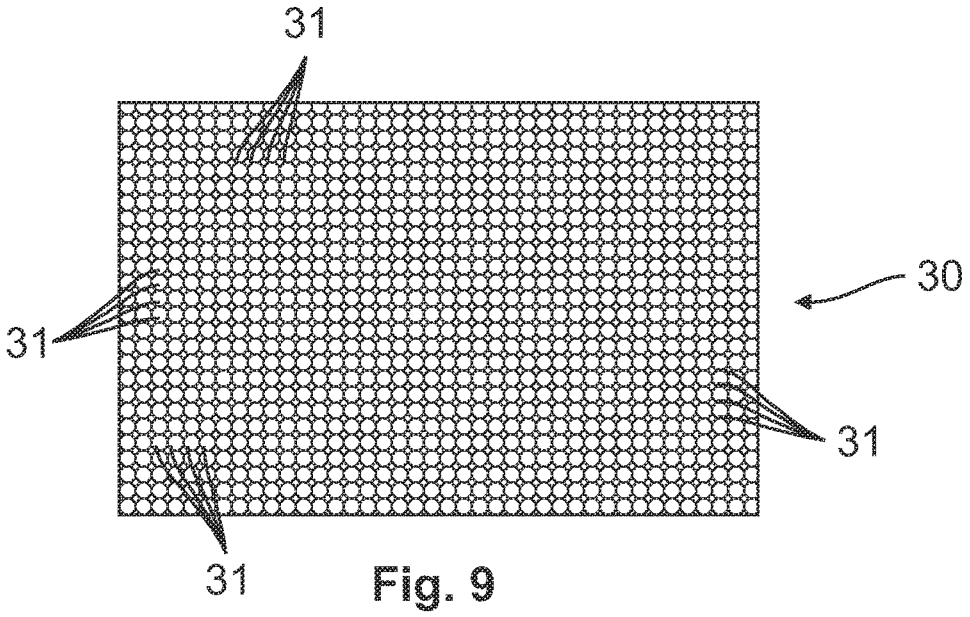
Figure 10:
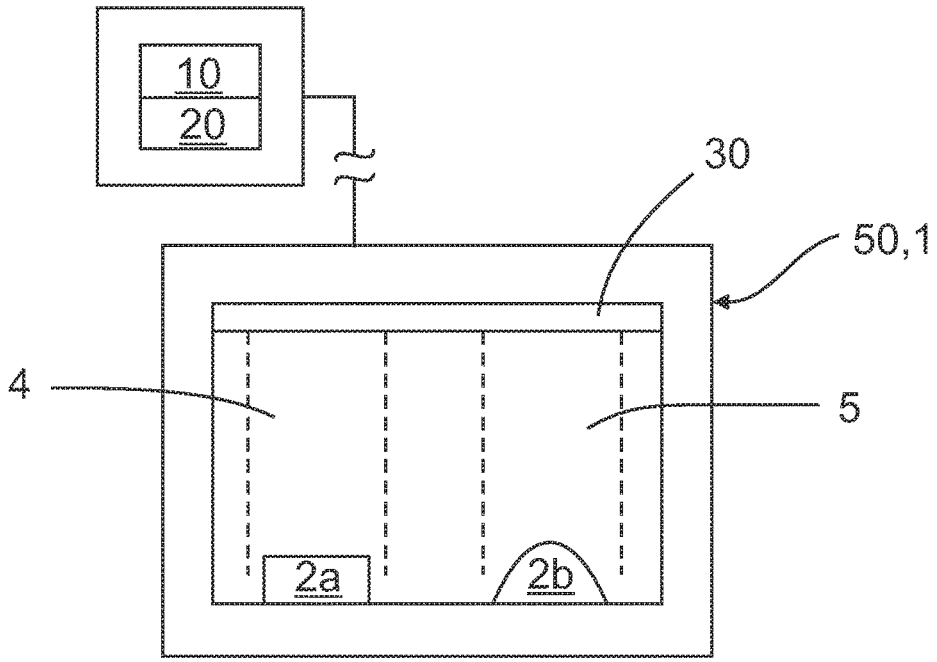

The energy unit 30 can be integrated in a wall 51, for example. FIG. 1 shows, by way of example, that the energy unit 30 is arranged on the ceiling 54. It is likewise conceivable, but not explicitly illustrated, that the energy unit 30 is alternatively or additionally arranged on the bottom 52 and/or in at least one side wall 53. It is shown in FIG. 9, for example, that the energy unit 30 is composed of a plurality of energy elements 31, which are arranged in the type of a matrix. The energy unit 30 is of planar design. Advantageously, the planar energy unit 30 is adapted to the dimensions of a wall 53, in particular the ceiling 54, which is shown in FIG. 1, for example. Each energy element 31 is formed as an antenna, by means of which energy can be emitted into the cooking chamber 3 as a high-frequency radiation. What is of particular advantage here, is that the antennas are formed in such a way that they can be controlled individually, so that a multitude of cooking chamber zones 4, 5 are formed in the cooking chamber 3, which is shown in FIG. 10. If, for example, the object detection 10 detects that two different types of food products 2 are present in the cooking chamber 3, first, the above-described determination of the cooking data 110 occurs. Subsequently, each food product located in the cooking chamber 3 can be cooked via the energy unit 30. In this case, the energy elements 31 are controlled correspondingly to emit the high-frequency radiation in the direction of the respective food product 2. The control unit 20 ensures that the energy unit 30 obtains the corresponding cooking data.

Figure 2:
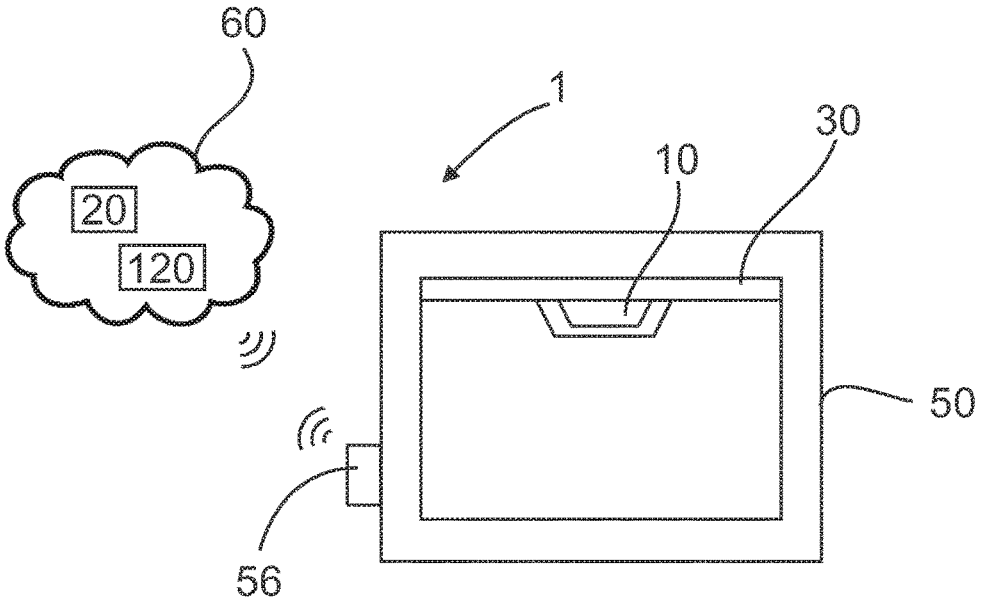
Figure 3:
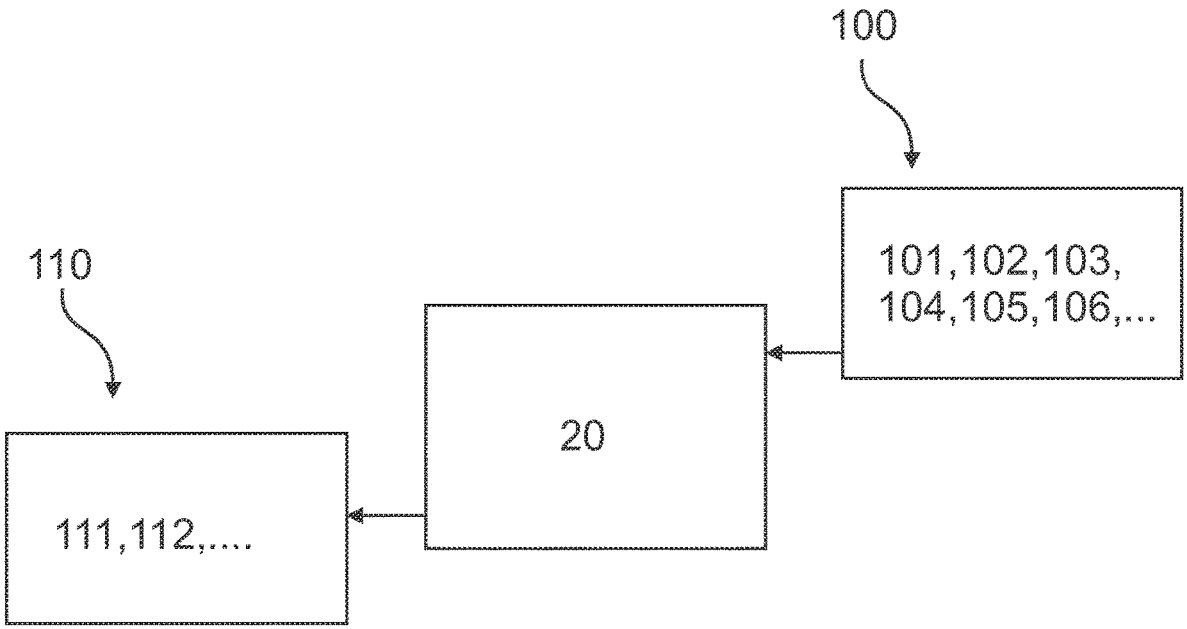

FIG. 2 shows that the system 1, 50 may comprise a cloud 60, which, for example, may comprise the database 120 and/or the control unit 20. The cooking device 50 comprises an interface 56 for the communication with the cloud 60. For example, the interface 56 can ensure that the input parameters 100 determined by the object detection 10 are sent to the cloud 60. The cloud 60 can, in accordance with FIG. 3 and/or FIGS. 5 to 8, be configured correspondingly in order to determine cooking data 110, wherein this data is subsequently sent to the cooking device 50. The energy unit 30 can be operated in accordance with the cooking data 110.

Figure 11:
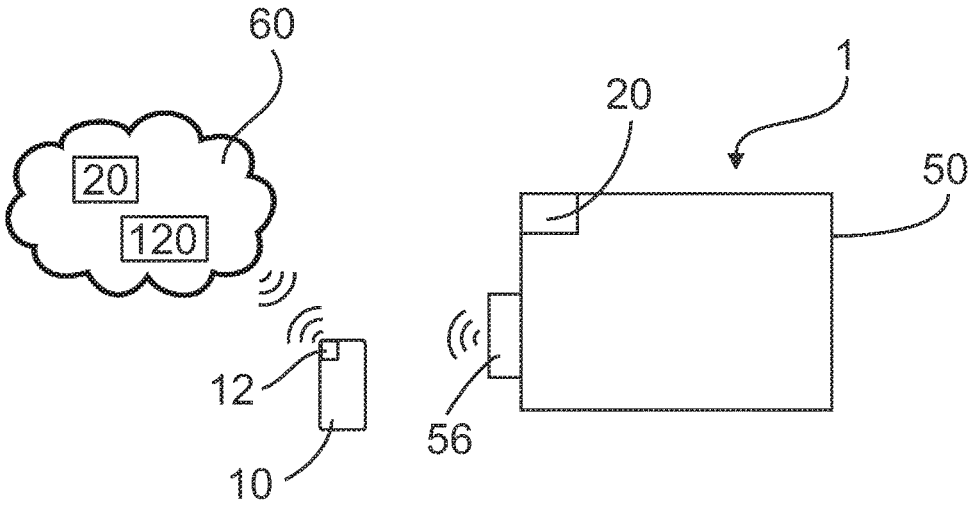

FIG. 11 schematically shows that the object detection 10 is located outside the cooking chamber 3, wherein the object detection 10 is a mobile object detection device 10, which, for example, can be carried in the hand of the user. Through the mobile object detection device 10, some or all of the input parameters 100 can be determined outside the cooking chamber 3. Subsequently, the object detection device 10 can emit the input parameters 100 of the cooking device 50 via its communication interface 12, which in turn receives this data via its interface 56. After that, the control unit 20 determines corresponding cooking data 110. Alternatively, it is conceivable that the cooking data 110 is determined within the mobile object detection device 10 and subsequently transmitted to the cooking device 50. In another exemplary embodiment of FIG. 11, it is also conceivable that the determined input parameters 100 are sent to a cloud 60 first, which, for example through a database 120 and/or a control unit 20, determines corresponding cooking data 110. The cooking data 110 determined in the cloud 60 can be directly transmitted to the cooking device 50 or, first, to the mobile object detection device 10, via which the cooking data 110 can then subsequently be provided to the cooking device 50.

Advantageously, the object detection 10 comprises a thermal insulation 13, see FIG. 1 and FIG. 2 by way of example, to protect the object detection 10 against heat, dirt, dust, etc. Just as well, in one exemplary embodiment, as shown in FIG. 1, the system 1, 50 can comprise a light source 15 to provide sufficient light for the object detection 10 for the determination of the input parameters of the food product 2. During the cooking process, the light source 15 can be brought into either an activated or deactivated state, which is advantageously selected by the user or by the system.

For example, in accordance with FIG. 1, the cooking device 50 can be configured with a display 55, which can display all input parameters 100, cooking data 110, for example. The user can also enter individual input parameters 100 via the display 55 and/or change cooking data 110 or enter them anew. The display 55 is advantageously in data communication with the control unit 20 and/or the object detection 10. FIG. 1 also shows that the cooking device 50 can also be used as a scale, wherein the weight 102 can be displayed to the user via the display 55, without that the actual cooking process is started.

Figure 12:
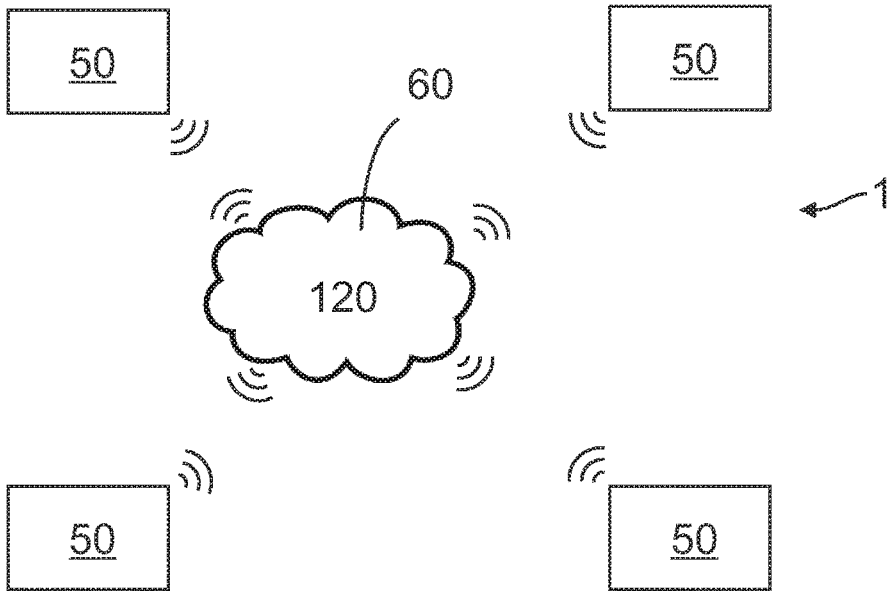

FIG. 12 shows another exemplary embodiment of the system 1 according to the invention, which is composed of a plurality of cooking devices 50, which are each in data communication with a cloud 60. The exemplary embodiment according to FIG. 2 and according to FIG. 11 is depictable in FIG. 12. It is likewise conceivable for the database 120 to be listed in the cloud 60. In other words, the cloud 60 can be configured to be self-learning, e.g. the database 120, via a plurality of measured input parameters 100, can be filled with data such that cooking data 110 can be derived for the remaining cooking devices 50 much faster and simpler.

According to FIG. 1, it is conceivable that an external unit 70 is provided, which is in data communication with the object detection 10 in order to obtain images and/or information during the cooking process, which the user can take from the external unit then. The external unit 70 can be a mobile computer and/or mobile phone or a display device, for example.

The features described in FIG. 1 can likewise be implemented in the systems according to FIGS. 2 to 12, to which reference is not explicitly made in order to avoid repetitions.

LIST OF REFERENCE CHARACTERS

1, 50 System
2 Food product
3 Cooking chamber
4 Cooking chamber zone
5 Cooking chamber zone
10 Object detection
12 Communication interlace
13 Thermal insulation
14 Camera
15 Light source
20 Control unit
30 Energy unit
31 Energy element
40 Device (weight measurement)
50 Oven, cooking device
51 Walls
52 Bottom
53 Side wall
54 Ceiling
55 Display
56 Interlace
60 Cloud
70 External unit
100 Input parameter
101 Size
102 Weight
103 Type
104 Quantity
105 Temperature
106 Position in the cooking chamber
110 Cooking data
111 Cooking duration
112 Cooking temperature
120 Database
130 Functional data

What is claimed is:

1. A system for a preparation of at least one food product, comprising:

a cooking device having a cooking chamber comprising walls defining the cooking chamber for the preparation of the food product located therein, and an energy unit to perform an energy supply specific to the food product into the cooking chamber dependent upon cooking data;

at least one camera for capturing at least one image of the food product located in the cooking chamber, and a device for measuring the weight of the food product located in the cooking chamber, and an object detection device configured for determining from the at least one image of the food product the following:

a position in the cooking chamber of the food product, a type of the food product and a size of the food product, a control unit, which determines the cooking data-based upon: the weight, and a plurality of input parameters comprising:

the position, the type, the size and the food product type weight and the position in the cooking chamber of the food product, the cooking data comprising a cooking duration, and a cooking temperature, wherein the control unit determines a preparation provision for cooking the food product located in the cooking chamber based on the preparation provision and automatically using the preparation provision without additional engagement by a user further to putting the food product in the cooking chamber.

2. The system according to claim 1, wherein the cooking data is calculated based on at least one food product parameter selected from a group consisting of:

size quantity temperature.

3. The system according to claim 1, wherein the system is a cooking device; wherein the object detection device comprises the at least one camera and the control unit calculates the weight of the food product based on the volume determined based on the at least one image and the type of food product.

4. The system according to claim 1, wherein the at least one camera includes multiple cameras are provided.

5. The system according to claim 2, further comprising a device for measuring said at least one food product parameter.

6. The system according to claim 5, wherein the weight of the product is determined based on the at least one food product parameter.

7. The system according to claim 1, wherein the device is a scale.

8. The system according to claim 1, wherein a database comprising functional data, which are at least partially in correlation with said input parameters.

9. The system according to claim 1, wherein the cooking device comprises walls, which delimit the cooking chamber.

10. The system according to claim 1, wherein the energy unit is arranged in at least one wall, wherein the energy unit comprises a plurality of energy elements, which are arranged in or on the at least one wall in such a way that a planar energy unit results.

11. The system according to claim 10, wherein the planar energy unit is adjusted to dimensions of the at least one wall, in which or on which the energy unit is arranged, wherein the planar energy unit corresponds to at least 50% of the dimension of the at least one wall, the planar energy unit corresponds to at least 80% of the dimension of the at least one wall.

12. The system according to claim 1, wherein the energy element is formed as an antenna, by means of which energy as a high-frequency radiation emitted into the cooking chamber.

13. The system according to claim 12, wherein the antennas are formed in such a way that they are controlled individually, so that a plurality of cooking chamber zones are created in the cooking chamber.

14. The system according to claim 1, wherein the cooking device comprises a display, by means of which the cooking data is displayed.

15. The system according to claim 1, wherein a cloud is provided, which comprises at least database or the control unit, wherein the system with the cloud is configured to be self-learning.

16. The system according to claim 1, wherein the at least one camera is outside the cooking chamber.

17. The system according to claim 1, wherein the at least one camera is located outside the cooking chamber; further comprising one or more communication interfaces, so that a data communication is possible at least between a cloud computing network or the cooking device or the control unit.

18. The system according to claim 1, further comprising a light source for illumination of the cooking chamber.

19. The system according to claim 1, wherein a thermal insulation is provided between the at least one camera and the cooking chamber.

20. A method of operating a system for preparation of at least one food product located in a cooking chamber, comprising:

operating at least one camera for capturing at least one image of a food product located in a cooking chamber of a cooking device, and operating a device for measuring the weight of the food product located in the cooking chamber, operating an object detection device for determining from the at least one image of the food product, the following:

a position in the cooking chamber of the food product, a type of the food product and a size of the food product;

operating a control unit to determine cooking data based upon:

the weight, and a plurality of input parameters comprising:

a position in the cooking chamber of the food product, a type of the food product and a size of the food product, operating the control unit to determines a preparation provision for cooking the food product located in the cooking chamber based on the preparation provision without additional engagement by a user further to putting the food product in the cooking chamber operating and an energy unit to perform an energy supply specific to the food product located in the cooking chamber dependent upon the cooking data, the cooking data comprising a cooking duration, and a cooking temperature determined based on the preparation provision.

21. The method according to claim 20, wherein the cooking data is calculated based on at least one food product parameter selected from a group consisting of:

size, quantity, temperature, wherein the cooking data determines a preparation provision for cooking the food product.

22. The method according to claim 20, wherein a database comprises functional data, which are at least partially in correlation with the at least one food product parameter, wherein the at least one food product parameter or the cooking data is determined from the functional data.

23. The method according to claim 21, wherein the type of the food product is received as an input parameter, and the weight is calculated in consideration of functional data.

24. The method according to claim 21, wherein the at least one food product parameter includes a size of the food product.

25. The method according to claim 20, wherein the energy unit comprises a plurality of energy elements, so that energy is continuously supplied to the cooking chamber, wherein energy is supplied to the cooking chamber in such a way, dependent upon at least the at least one food product parameter or the cooking data, that multiple cooking chamber zones are created, which is operated with different cooking data.

26. The method according to claim 20, wherein the control unit is in data communication with an external unit, in order to send cooking data or the at least one image during the cooking process to the external unit, wherein the external unit is at least a mobile computer or a mobile phone or a tablet computer or a display device.

* * * * *